US006311506B1

(12) United States Patent
Takahashi et al.

(10) Patent No.: US 6,311,506 B1
(45) Date of Patent: Nov. 6, 2001

(54) CONTROL UNIT FOR REFRIGERATING MACHINE

(75) Inventors: Norio Takahashi; Tsutomu Hatanaka; Toshiyuki Kamei, all of Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/348,459

(22) Filed: Jul. 7, 1999

(30) Foreign Application Priority Data

Jul. 9, 1998 (JP) ..... 10-194329

(51) Int. Cl.[7] ..... F25B 41/06
(52) U.S. Cl. ..... 62/196.4; 62/201
(58) Field of Search ..... 62/196.4, 196.1, 62/201, 197, 203, 204, 205, 208

(56) References Cited

U.S. PATENT DOCUMENTS 3,368,364 * 2/1968 Norton et al. ..... 62/196.4 X
3,555,843 * 1/1971 Cook ..... 62/196.4
4,749,312 * 6/1988 Raibaud ..... 406/30
4,926,733 * 5/1990 Jason ..... 83/819
4,957,085 * 9/1990 Sverdlin ..... 123/467
5,076,068 * 12/1991 Mikhail ..... 62/201 X
5,183,101 * 2/1993 Penaluna et al. ..... 62/196.4 X
5,551,249 * 9/1996 Van Steenburgh, Jr. ..... 62/201 X

FOREIGN PATENT DOCUMENTS 60-2777 1/1985 (JP) .

* cited by examiner

*Primary Examiner*—Harry B. Tanner
(74) *Attorney, Agent, or Firm*—Vardnell & Vardnell, PLLC

(57) ABSTRACT

A control unit is disclosed for controlling a refrigerating machine in such a way that a refrigerating power exceeding the required performance is secured while the control unit has a function of bypassing hot gas by means of a hot gas bypass line. A temperature-responsive valve is mounted in the hot gas bypass line in addition to a pressure regulating valve. If a preset temperature Tr of a brine becomes equal to or higher than a given temperature (0° C.), the temperature-responsive valve opens the bypass line. If the preset temperature Tr becomes lower than the given temperature, the temperature-responsive valve closes the bypass line.

4 Claims, 9 Drawing Sheets

CONTROL UNIT FOR REFRIGERATING MACHINE

FIELD OF THE INVENTION

The present invention relates to a control unit for a refrigerating machine and, more particularly, to a control unit capable of securing refrigerating capability more than required.

DESCRIPTION OF THE PRIOR ART

FIG. 8 shows the whole construction of a temperature control system that acts as a refrigerating machine and incorporates a chiller 10. This temperature control system chiefly consists of the chiller 10, a controlled object 1 whose temperature is to be controlled, and a circulatory fluid line 3 between the chiller 10 and the controlled object 1. For example, the controlled object 1 is a vacuum chamber that surface-processes or otherwise processes semiconductor wafers under a desired temperature.

In the chiller 10 described above, a compressor 12, a condenser 13, an expansion valve 14, and an evaporator 11 are connected in series via a conduit 15. A refrigerant 16 is passed through this conduit 15 to carry out refrigeration cycles. A brine (anti-freezing fluid) 17 circulating through the circulatory fluid line 3 exchanges heat with the refrigerant 16, thus cooling the brine 17. Thus, it is maintained at a preset temperature. As a result, the controlled object 1 is controlled to a target temperature.

FIG. 11 particularly shows the line arrangement in the chiller 10.

This chiller 10 has a hot gas bypass line 18 that provides a bypass line for gas delivered from the compressor 12 and sends it to the evaporator 11.

A pressure regulating valve 19 is mounted in the hot gas bypass line 18 to open this line 18 when the vapor pressure of the refrigerant 16 in the evaporator 11 becomes equal to or less than a given pressure, thus permitting passage of the hot gas. When the vapor pressure of the refrigerant 16 in the evaporator 11 becomes higher than the given pressure, the regulating valve 19 closes the hot gas bypass line 18, thus cutting off the hot gas.

The pressure regulating valve 19 is installed to maintain the vapor pressure higher than the preset pressure, for the following reason. If the vapor pressure becomes equal to or lower than the preset pressure (atmospheric pressure), the refrigerant 16 does not sufficiently vaporize within the evaporator 11 and returns to the compressor 12 while maintained in a liquid state. This is so-called the phenomenon of the fluid back and may damage the compressor 12.

The pressure regulating valve 19 operates according to the difference between the vapor pressure of the entering refrigerant 16 and the force of a spring.

Because of the mechanical structure of the prior art pressure regulating valve 19, the valve operates according to the difference between the vapor pressure of the entering refrigerant 16 and a spring force, even if the vapor pressure becomes higher than the given pressure, the valve 19 is slightly open, and the hot gas is bypassed to the evaporator 11 via the hot gas bypass line 18.

If the hot gas is unnecessarily bypassed to the evaporator 11, the refrigerating capability becomes deteriorated. As the preset temperature of the brine 17 (i.e., the target temperature of the controlled object 1) becomes lower, the refrigerating capability becomes lower. Therefore, if the hot gas is undesirably bypassed where the preset temperature of the brine 17 is low, the refrigerating capability drops conspicuously.

The chiller 10 according to the present invention is required to exhibit a refrigerating power of more than 1 kW when the temperature of the brine 17 is −20° C., and to exhibit a refrigerating power of 2 kW or more where the temperature of the brine 17 is 0° C.

FIG. 10 shows the relation between the brine temperature and the cooling power where the hot gas is not bypassed (indicated by the broken line) and bypassed (indicated by the solid line). As can be seen from the graph of FIG. 10, where the brine 17 has a high temperature of 0° C., a refrigerating power of 2 kW or more is secured, whether the hot gas is bypassed or not. Thus, the required performance is satisfied.

However, as the temperature of the brine 17 becomes lower, the refrigerating power drops conspicuously where the hot gas is bypassed. Where the temperature of the brine 17 is −20° C., the power is much lower than the required power of 1 kW. Consequently, it is impossible to meet the required performance.

If the compressor 10 is replaced by one having a sufficiently large capacity, the refrigerating performance may be enhanced, and the required refrigerating power may be secured even if the hot gas is bypassed.

However, increasing the capacity of the compressor 10 to a sufficiently large value will incur an increase in cost. Furthermore, the equipment will become bulky, which in turn will occupy more space. Moreover, the electric power consumption will increase. Accordingly, increasing the capacity of the compressor 10 is not acceptable.

SUMMARY OF THE INVENTION

In view of the foregoing circumstances, the present invention has been made. It is a first object of the present invention to provide a control unit capable of imparting required refrigerating capability to a refrigerating machine without incurring an increase in cost, size, or electric power consumption.

The prior art pressure regulating valve 19 has intrinsic problems. That is, if the vapor pressure is higher than a given pressure, the valve 19 is slightly open, because the valve mechanically operates in response to the vapor pressure as mentioned above. If the hot gas is undesirably bypassed by the opening of the valve 19, the refrigerating capability will be deteriorated. Especially, if the vapor pressure is low, the amount of refrigerant circulated becomes small and so the refrigerating power decreases conspicuously.

It is a second object of the invention to provide a control unit that causes pressure regulating valve 19 of a refrigerating machine to operate more precisely in response to vapor pressure than that of the prior art, thus preventing the refrigerating capability from deteriorating.

A first embodiment of the present invention achieves the first object described above and provides a control unit for use with a refrigerating machine in which a compressor, a condenser, and an evaporator are connected in series via a conduit. The refrigerating machine further includes a hot gas bypass line for bypassing hot gas discharged from the compressor. A pressure regulating valve is installed in the hot gas bypass line to open the hot gas bypass line, if the vapor pressure of a refrigerant inside the evaporator becomes equal to or lower than a given pressure, thus passing the hot gas. If the vapor pressure of the refrigerant in the evaporator becomes higher than the given pressure, the pressure regulating valve closes the hot gas bypass line to cut off the hot gas. The refrigerant exchanges heat with a brine passing through the evaporator to maintain the brine at a preset temperature.

A temperature-responsive valve is mounted in the hot gas bypass line. If the temperature of the brine is equal to or higher than the given temperature, the temperature-responsive valve opens the hot gas bypass line. If the temperature of the brine is lower than the given temperature, the temperature-responsive valve closes the hot gas bypass line.

In the first embodiment of the invention described above, as shown in FIG. 1, a temperature-responsive valve 20 is mounted in a hot gas bypass line 18. If the preset temperature Tr of the brine 17 rises equal to or higher than a given temperature (0° C.), the valve 20 opens the hot gas bypass line 18. If the preset temperature Tr of the brine 17 is lower than the given temperature (0° C.), the valve 20 closes the hot gas bypass line 18.

Therefore, when the preset temperature of the brine is equal to or higher than the given temperature of 0° C., the hot gas bypass line 18 is opened. The pressure regulating valve 19 operates and bypasses the hot gas. At this time the temperature of the brine and the refrigerating power have a relation as indicated by the solid line in FIG. 10. Accordingly, when the preset temperature Tr of the brine 17 is 0° C. or more, the refrigerating power exceeds the required refrigerating power of 2 kW. Where the preset temperature Tr of the brine 17 is lower than the given temperature 0° C., the hot gas bypass line 18 is closed. The pressure regulating valve 19 does not function and thus does not bypass the hot gas. At this time, the brine temperature and the refrigerating power have a relation indicated by the broken line in FIG. 10. Therefore, even if the preset temperature Tr of the brine 17 is −20° C., the refrigerating power is in excess of the required refrigerating power of 1 kW.

As described thus far, in the first embodiment of the present invention, a refrigerating power exceeding the required performance can be secured while maintaining the function of bypassing the hot gas.

A second embodiment of the present invention is based on the first embodiment described above and characterized in that the aforementioned temperature-responsive valve is a control valve that is opened and closed in response to an ON/OFF input command signal.

A third embodiment of the present invention is intended to achieve the aforementioned first object of the present invention and provides a refrigerating machine in which a compressor, a condenser, and an evaporator are connected in series via a conduit. The refrigerating machine has a hot gas bypass line for bypassing hot gas discharged from the compressor. A pressure regulating valve is mounted in the hot gas bypass line to open the hot gas bypass line, if the vapor pressure of the refrigerant inside the evaporator becomes equal to or lower than a given pressure, thus passing the hot gas. If the vapor pressure of the refrigerant inside the evaporator becomes higher than the given pressure, the pressure regulating valve closes the hot gas bypass line, cutting off the hot gas. The refrigerant exchanges heat with the brine passing through the evaporator to maintain the brine at a preset temperature.

A temperature-responsive valve is mounted in the hot gas bypass line. If the actual temperature of the brine is equal to or higher than the given temperature, the temperature-responsive valve opens the hot gas bypass line. If the actual temperature of the brine is lower than the given temperature, the temperature-responsive valve closes the hot gas bypass line.

A fourth embodiment of the invention is based on the third embodiment described above and characterized in that the aforementioned temperature-responsive valve is a control valve which is opened and closed in response to an ON/OFF input command signal.

A fifth embodiment of the invention achieves the second object of the invention described above and provides a refrigerating machine in which a compressor, a condenser, and an evaporator are connected in series via a conduit. The refrigerating machine has a hot gas bypass line for bypassing hot gas discharged from the compressor. A pressure regulating valve is mounted in the hot gas bypass line to open the hot gas bypass line, if the vapor pressure of the refrigerant inside the evaporator becomes equal to or lower than a given pressure, thus passing the hot gas. If the vapor pressure of the refrigerant inside the evaporator becomes higher than the given pressure, the regulating valve closes the hot gas bypass line, cutting off the hot gas.

A pressure detection means is mounted to detect the vapor pressure of the refrigerant inside the evaporator. Instead of the pressure regulating valve, a pressure-responsive valve is mounted in the hot gas bypass line. If the vapor pressure detected by the pressure detection means becomes equal to or lower than the given pressure, the temperature-responsive valve opens the hot gas bypass line. If the vapor pressure detected by the pressure-responding means becomes higher than the given pressure, the temperature-responsive valve closes the hot gas bypass line.

In accordance with the fifth embodiment described above, as shown in FIG. 5, a pressure detection means 25 is mounted to detect vapor pressure P of a refrigerant 16 inside an evaporator 11. A pressure-responsive valve 23 is mounted in a hot gas bypass line 18 instead of the pressure regulating valve 19. When the vapor pressure P detected by the pressure detection means 25 becomes equal to or lower than a given pressure (e.g., atmospheric pressure), the valve 23 opens the hot gas bypass line 18. When the vapor pressure P detected by the pressure detection means 25 becomes higher than the given pressure (e.g., atmospheric pressure), the valve 23 closes the hot gas bypass line 18.

In accordance with the fifth embodiment described above, when the vapor pressure P detected by the pressure detection means 25 becomes equal to or lower than the given pressure (e.g., atmospheric pressure), the pressure-responsive valve 23 is opened. Thus, the vapor pressure P is kept higher than the given pressure (e.g., atmospheric pressure). Therefore, it can prevent the phenomenon of the fluid back (i.e., the vapor pressure becomes equal to or lower than the atmospheric pressure, and the refrigerant 16 does not sufficiently vaporize inside the evaporator 11 and returns to the compressor 12 while kept in a liquid state) of the liquid in the same way as the prior art pressure regulating valve 19. Hence, damage to the compressor 12 and other dangers can be prevented.

In accordance with the fifth embodiment of the invention, the pressure-responsive valve 23 is precisely opened and closed in response to the vapor pressure P detected by the pressure detection means 25. Therefore, if the vapor pressure P becomes higher than the given pressure (e.g., atmospheric pressure), the valve 23 is prevented from being opened. Consequently, unwanted bypassing of the hot gas is circumvented. Hence, the refrigerating power can be prevented from deteriorating.

A sixth embodiment of the present invention is based on the fifth embodiment described above and characterized in that the aforementioned pressure-responsive valve is a control valve that is opened and closed in response to an ON/OFF input command signal.

A seventh embodiment of the invention is based on the fifth embodiment described above and characterized in that the aforementioned pressure-responsive valve is a control valve that is opened and closed by an amount corresponding to the contents of a command.

An eighth embodiment of the present invention achieves the second object described above and provides a refrigerating machine in which a compressor, a condenser, and an evaporator are connected in series via a conduit. The refrigerating machine has a hot gas bypass line for bypassing hot gas discharged from the compressor. A pressure regulating valve is mounted in the hot gas bypass line to open the hot gas bypass line, if the vapor pressure of the refrigerant inside the evaporator becomes equal to or lower than a given pressure, thus passing the hot gas. If the vapor pressure of the refrigerant inside the evaporator becomes higher than the given pressure, the regulating valve closes the hot gas bypass line, cutting off the hot gas.

A temperature detection means is mounted to detect the temperature of the refrigerant inside the evaporator. Instead of the pressure regulating valve, a temperature-responsive valve is mounted in the hot gas bypass line. If the temperature of the refrigerant detected by the temperature detection means becomes equal to or lower than a given temperature, the temperature-responsive valve opens the hot gas bypass line. If the temperature of the refrigerant detected by the temperature detection means becomes higher than the given temperature, the temperature-responsive valve closes the hot gas bypass line.

A ninth embodiment of the present invention is based on the eighth embodiment of the invention and characterized in that the aforementioned temperature-responsive valve is a control valve that is opened and closed in response to an ON/OFF input command signal.

A tenth embodiment of the invention is based on the eighth embodiment of the invention and characterized in that the temperature-responsive valve is a control valve that is opened and closed by an amount corresponding to contents of a command.

Other objects and features of the invention will appear in the course of the description thereof, which follows.

DETAILED DESCRIPTION OF THE INVENTION

Figure 8:
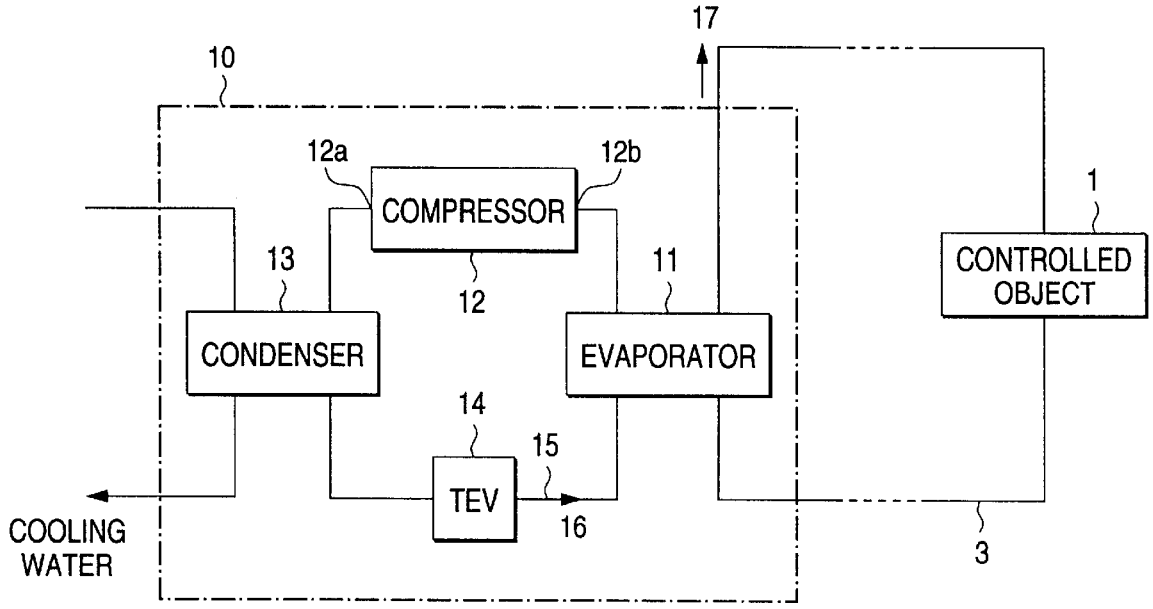
FIG. 8 is a conceptual diagram of a temperature control unit as a whole system according to the preferred embodiments of the invention.

FIG. 8 conceptually illustrates the whole system of a refrigerating machine and a control unit in accordance with the present invention, which is a temperature control machine including a chiller 10 acting as a refrigerating machine.

This temperature control machine consists mainly of the chiller 10, an object 1 whose temperature is to be controlled, and a circulatory fluid line 3 between the chiller 10 and the controlled object 1.

For example, the controlled object 1 is a vacuum chamber for surface-processing semiconductor wafers under a desired temperature. A heat storage tank, a halogen lamp, and so on (none of which are shown in FIG. 8) needed for the temperature control are mounted in th e circulatory fluid line 3.

In the chiller 10 described above, a compressor 12, a condenser 13, an expansion valve 14, and an evaporator 11 are connected in series via a conduit or liquid line 15. A refrigerant 16 is flowed through this conduit 15 to carry out refrigeration cycles.

In particular, the refrigerant 16 is compressed at a high temperature and at a high pressure in the compressor 12. The vapor of the refrigerant that is made to have high temperature and high pressure by the operation of the compressor 12 is discharged from the discharge port 12*a* of the compressor 12 and sent to the condenser 13. The vapor of the refrigerant gives heat to the outside air through the condenser 13. The refrigerant vapor is cooled with cooling water into liquid that is saturated or subcooling. The liquid refrigerant is sent to a thermostatic expansion valve (TEV) 14, where the liquid refrigerant undergoes throttled expansion and becomes a low-pressure wet vapor, which in turn is sent to the evaporator 11. In this evaporator 11, the refrigerant 16 exchanges heat with the brine 17 that is cooled fluid. That is, the refrigerant 16 takes heat from the brine 17 circulated through the circulatory fluid line 3, evaporates, and becomes dry saturated vapor or superheated vapor. The refrigerant 16 is returned into the suction port 12*b* of the compressor 12. The refrigerating cycle carried out in the chiller 10 has been described thus far.

The brine 17 is cooled in this way and maintained at a preset temperature. The brine 17 is heated by a halogen lamp (not shown) or the like. In this manner, the controlled object 1 is controlled so as to achieve a target temperature.

In this embodiment, a thermostatic expansion valve is used as the expansion valve 14. Of course, a hand expansion valve or a constant-pressure expansion valve may be used instead. Furthermore, a capillary tube may be employed instead of the expansion valve 14.

HCFC-22 is used as the refrigerant 16. Of course, ammonia, R-12, R-22, R-500, R-404A, R-407C, R-410A, or other refrigerant may also be used.

Liquids used for the brine 17 can include Fluorinert®, which is an electronic liquid used as a heat transfer media that is an excellent dielectric material and is safe for use in a recirculating chiller environment. Of course, ethylene glycol, oil, water, and other liquids can also be used for the brine 17. Furthermore, nitrogen, air, helium, and other gases may be used. In summary, any brine suitable for the target temperature to be controlled can be appropriately selected.

The condenser 13 can be water-cooled with cooling water. Besides, it can be an air-cooled condenser.

Figure 1:
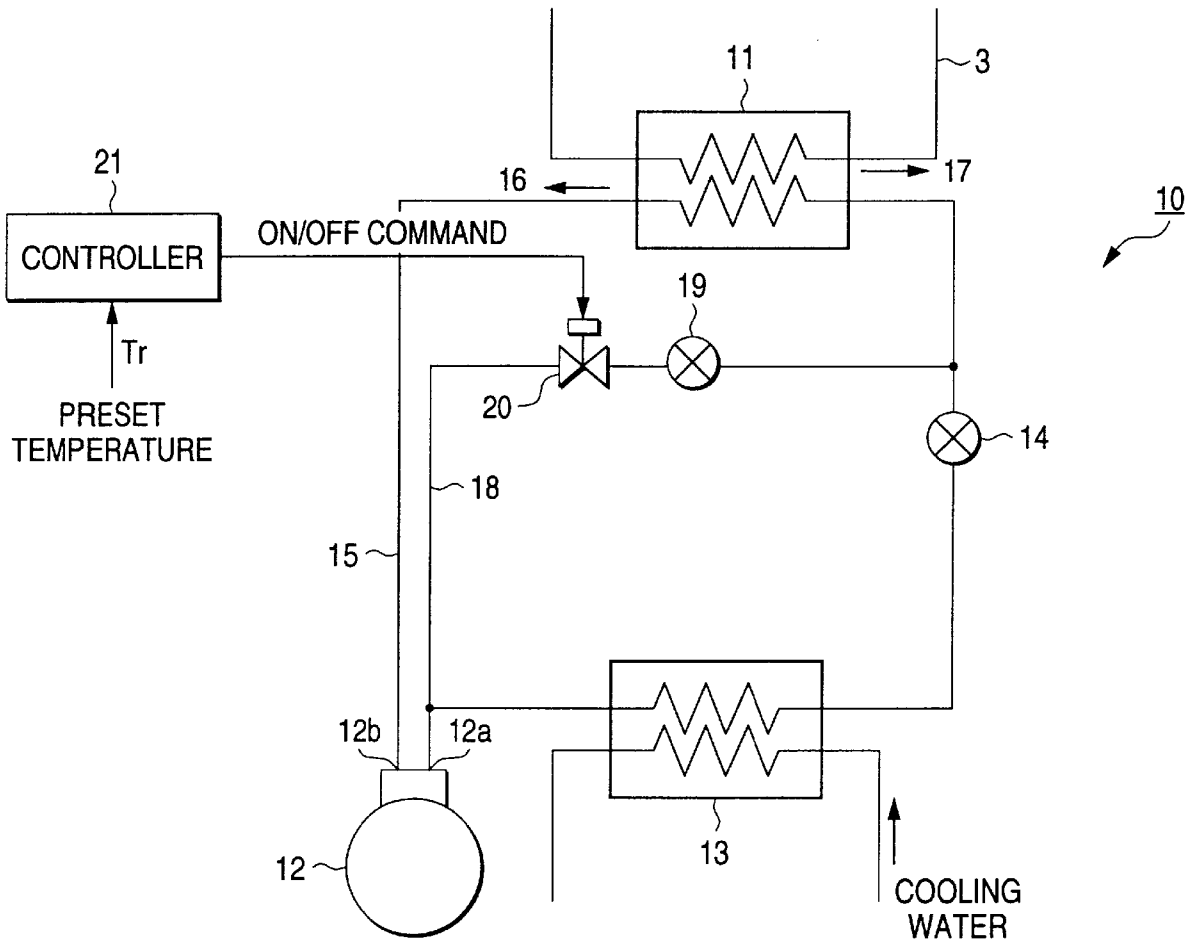
FIG. 1 is a line diagram of a control unit and a refrigerating machine for use with the control unit in accordance with the present invention.

FIG. 1 particularly shows the line structure of the chiller 10 in the present embodiment. This chiller 10 has a hot gas bypass line 18 for placing the discharge port 12*a* of the compressor 12 in communication with the line between the thermostatic expansion valve 14 and the evaporator 11 to bypass the hot gas discharged from the compressor 12 into the entrance of the evaporator 11.

A pressure regulating valve 19 is mounted in the hot gas bypass line 18 to open the bypass line 18, if the vapor pressure of the refrigerant 16 in the evaporator becomes equal to or lower than a given pressure (e.g., atmospheric pressure), thus permitting passage of the hot gas. If the vapor pressure of the refrigerant 16 inside the evaporator 11 becomes higher than the given pressure (atmospheric pressure), the valve 19 closes the bypass line 18, thus cutting off the hot gas. The pressure regulating valve 19 is a valve operating according to the difference between the pressure of the entering vapor pressure and the force of a spring. In this embodiment, the given pressure that is a threshold value at which the hot gas bypass line 18 begins to be opened or closed is the atmospheric pressure. However, threshold values other than the atmospheric pressure may also be established.

In the present embodiment, a solenoid valve 20 is mounted in the hot gas bypass line 18 and in the line between the pressure regulating valve 19 and the discharge port 12*a* of the compressor 12. If the preset temperature Tr of the brine 17 becomes equal to or higher than the given temperature (0° C.), the solenoid valve 20 opens the hot gas bypass line 18. If the preset temperature Tr becomes lower than the given temperature (0° C.), the solenoid valve 20 closes the hot gas bypass line 18.

As is well known in the art, the solenoid valve 20 is opened and closed by an electromagnetic force produced when a coil is electrically energized. In the present embodiment, an ON/OFF command current sent from an external controller 21 activates or deactivates the solenoid valve 20, thus opening or closing the hot gas bypass line 18.

The controller 21, which is shown in FIG. 1, controls the refrigerating machine as follows.

The preset temperature Tr of the brine 17 is entered into the controller 21 through an entry means such as a keyboard.

The controller 21 makes a decision as to whether the entered preset temperature Tr of the brine 17 is equal to or higher than the given temperature (0° C.).

If the entered preset temperature Tr is equal to or higher than the given temperature (0° C.), an ON command current is supplied to the solenoid valve 20 for activating it. As a result, the solenoid valve 20 is activated, thus opening the hot gas bypass line 18.

If the preset temperature Tr of the brine 17 entered into the controller 21 is lower than the given temperature (0° C.), an OFF command current is supplied to the solenoid valve 20 for deactivating it. In consequence, the solenoid valve 20 is deactivated, closing the hot gas bypass line 18.

The advantages of the present invention are next described by referring again to FIG. 10.

The chiller 10 used in this embodiment is required to show a refrigerating power of 1 kW or more where the temperature of the brine 17 is −20° C. and a refrigerating power of 2 kW or more where the temperature of the brine 17 is 0° C.

In the present embodiment, where the preset temperature Tr of the brine 17 is equal to or higher than 0° C., the hot gas bypass line 18 is opened. Therefore, the pressure regulating valve 19 adjusts the refrigerating power under the presence of the hot gas bypass line.

Figure 10:
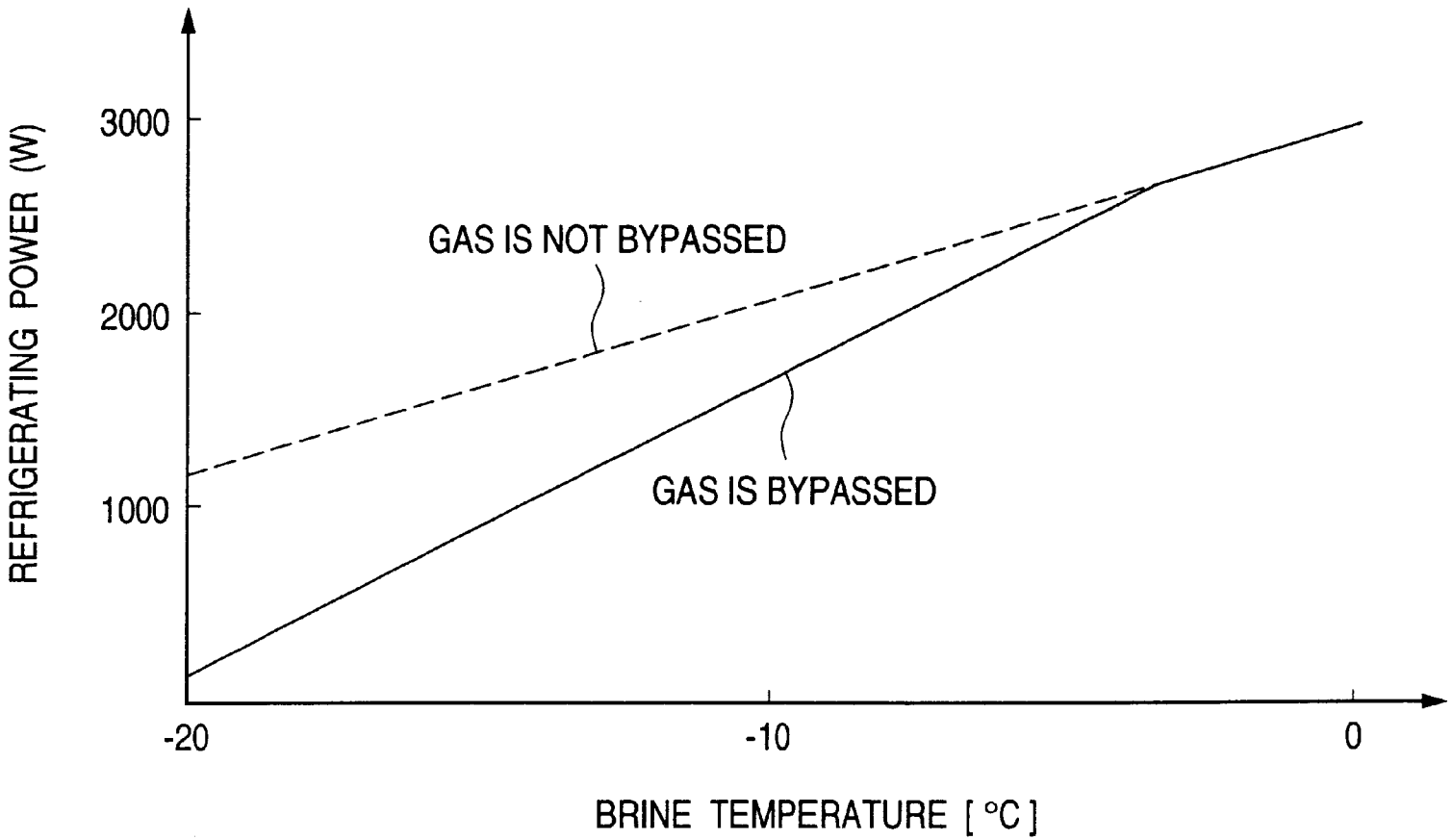
FIG. 10 is a graph in which refrigerating power is plotted against the temperature of a brine.
Figure 11:
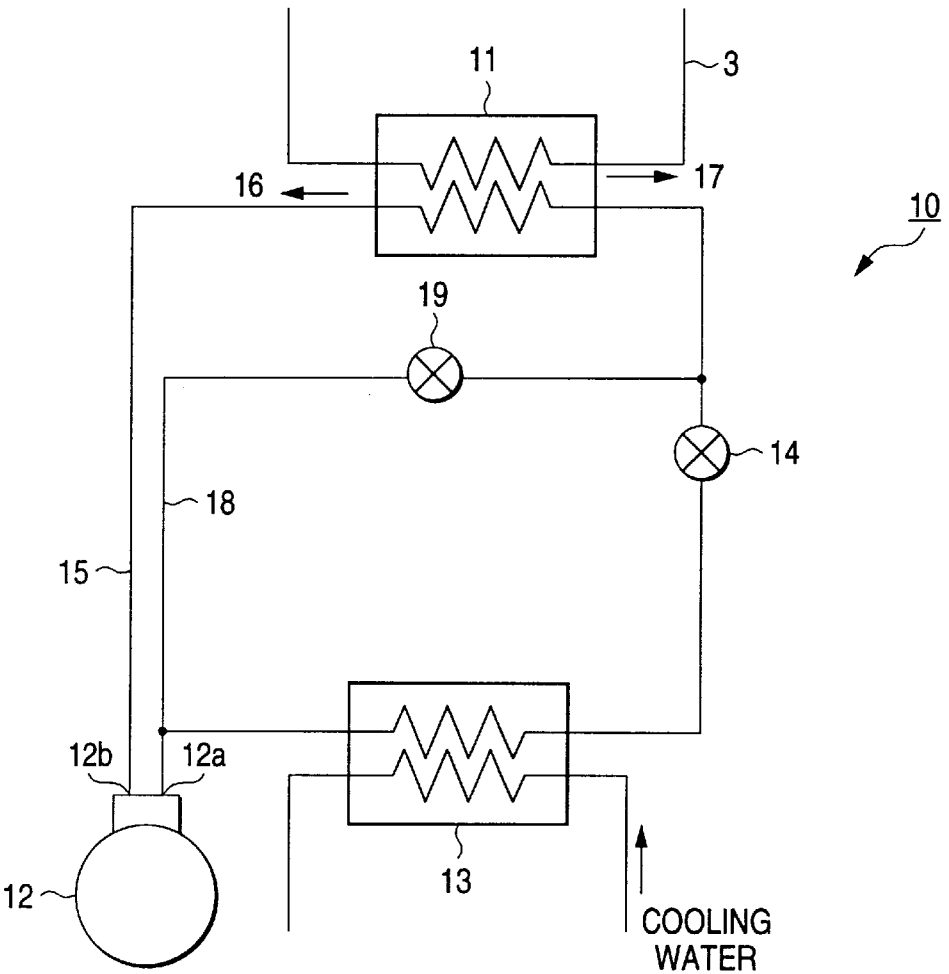
FIG. 11 is a line diagram of the prior art refrigeration machine.

At this time (in the presence of the hot gas bypass line), the brine temperature and the refrigerating power have a relation as indicated by the solid line in FIG. 10. Therefore, when the preset temperature Tr of the brine 17 is 0° C., the refrigerating power exceeds the required refrigerating power of 2 kW.

Where the preset temperature Tr of the brine 17 is lower than 0° C., the hot gas bypass line 18 is closed, and the refrigerating power adjusting function of the pressure regulating valve 19 does not function in the absence of the hot gas bypass line. Under this condition, the brine temperature and the refrigerating power have a relation as indicated by the broken line in FIG. 10. Therefore, where the preset temperature Tr of the brine 17 is −20° C., the refrigerating power is in excess of the required refrigerating power of 1 kW.

As described thus far, in the present embodiment, a refrigerating power exceeding the required performance can be secured while maintaining the function of bypassing the hot gas.

Figure 2:
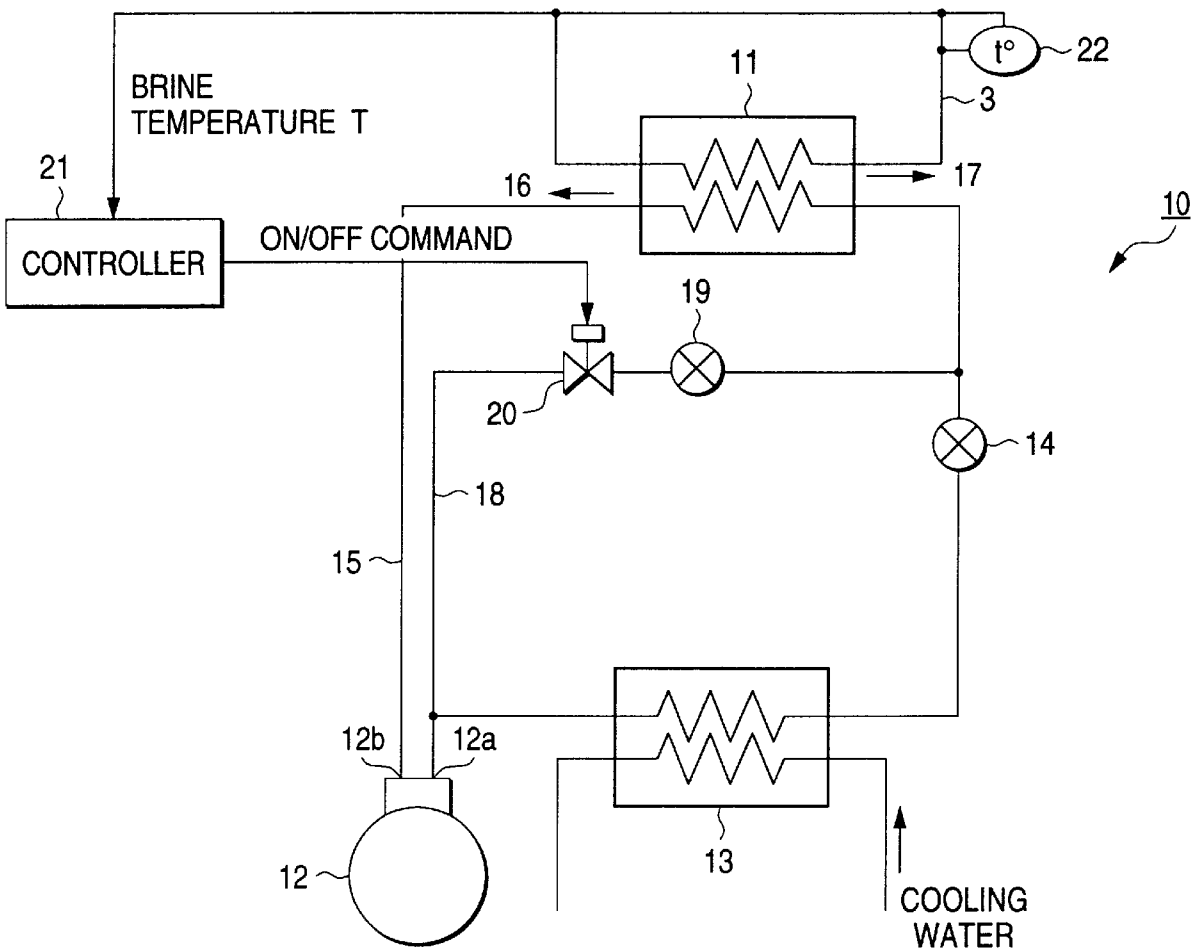
FIG. 2 is a line diagram of a modification of the refrigerating machine and control unit shown in FIG. 1.

A modification of the machine shown in FIG. 1 is next described by referring to FIG. 2.

In the machine shown in FIG. 2, the solenoid valve 20 is not controlled according to the preset temperature Tr of the brine 17. Rather, the solenoid valve 20 is controlled according to the actual temperature T of the brine 17.

In the present embodiment, a temperature sensor 22 is mounted in the circulatory fluid line 3 through which the brine 17 is circulated, to detect the actual temperature T of the brine 17.

The actual temperature T of the brine 17 detected by the temperature sensor 22 is input to the controller 21.

Figure 3:
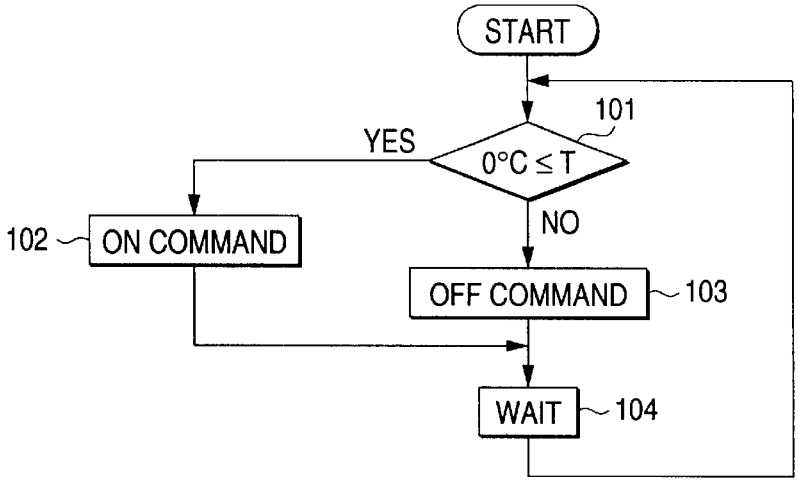
FIG. 3 is a flowchart illustrating a sequence of operations executed by a controller shown in FIG. 2.

The controller 21 performs processing as illustrated in FIG. 3.

In particular, a decision is made as to whether the actual temperature T of the brine 17 is equal to or higher than the given temperature (0° C.) (step 101).

If the result of the decision is YES (i.e., the actual temperature T of the brine 17 is equal to or higher than the given temperature (0° C.)), control goes to step 102, where an ON command current is produced to the solenoid valve 20 to activate it. As a result, the solenoid valve 20 is activated, and the hot gas bypass line 18 is opened.

On the other hand, if the result of the decision made in step 101 is NO (i.e., the detected temperature T of the brine 17 entered into the controller 21 is lower than the given temperature (0° C.)), an OFF command current is delivered to the solenoid valve 20 to deactivate it. As a result, the solenoid valve 20 is deactivated, and the hot gas bypass line 18 is closed.

Also in this embodiment shown in FIG. 2, a refrigerating power exceeding the required performance can be obtained while maintaining the function of bypassing the hot gas, in the same way as in the embodiment shown in FIG. 1.

In the embodiment shown in FIGS. 1 and 2, the solenoid valve 20 is mounted in the hot gas bypass line 18 between the pressure regulating valve 19 and the discharge port 12*a* of the compressor 12. Of course, the solenoid valve 20 may be installed in the line between the pressure regulating valve 19 and the entrance of the evaporator 11.

The prior art pressure regulating valve 19 has intrinsic problems. That is, if the vapor pressure is higher than a given pressure (atmospheric pressure), the valve 19 is slightly open, because the valve mechanically operates in response to the difference between the vapor pressure and the spring force as mentioned above. If the hot gas is undesirably bypassed by the opening of the valve 19, the refrigerating capability will be deteriorated. Especially, if the vapor pressure is low, the amount of refrigerant 16 circulated is small and so the refrigerating capability decreases conspicuously.

Accordingly, in the embodiments described below, the pressure regulating valve 19 is made to operate more precisely than the prior art pressure adjusting valve to prevent the refrigerating power from deteriorating.

Figure 5:
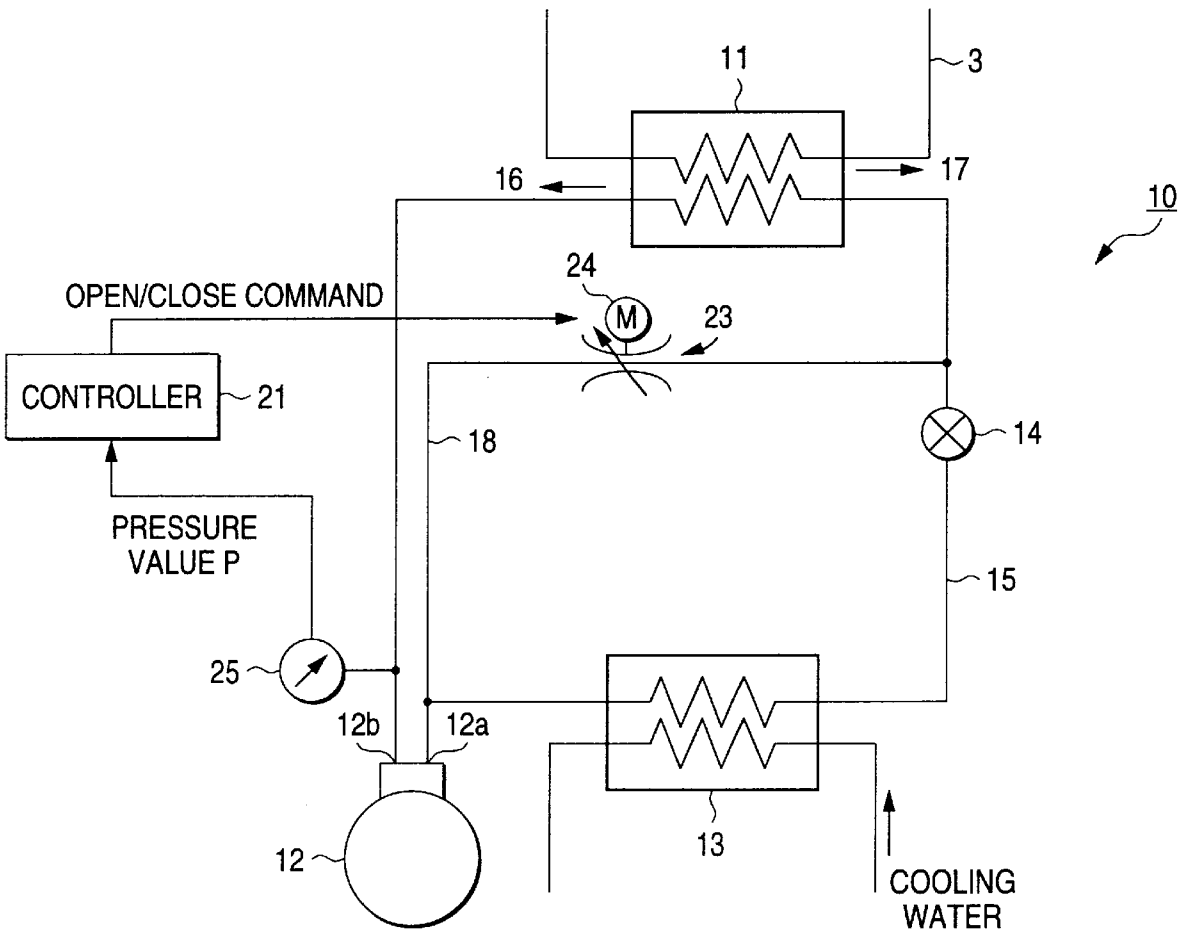
FIG. 5 is a line diagram of another control unit and a refrigerating machine for use with the control unit in accordance with the invention.

In the chiller 10 shown in FIG. 5, a proportional valve 23 operating according to vapor pressure detected by a pressure sensor 25 is used instead of the prior art pressure regulating valve 19.

That is, in this chiller 10 shown in FIG. 5, the proportional valve 23 is mounted in the hot gas bypass line 18 instead of the pressure regulating valve 19.

This proportional valve 23 is driven by an electric motor 24, and its degree of opening is adjusted according to the amount of motion of the motor 24. This motor 24 is driven according to a command current delivered from the controller 21.

A pressure sensor 25 is mounted in the line 15 between the evaporator 11 and the suction port 12*b* of the compressor 12 to detect the vapor pressure P of the refrigerant 16 inside the evaporator 11. The vapor pressure is the pressure of gas evaporated from the refrigerant 16 inside the evaporator 11.

The vapor pressure P detected by the pressure sensor 25 is applied to the controller 21.

Figure 4:
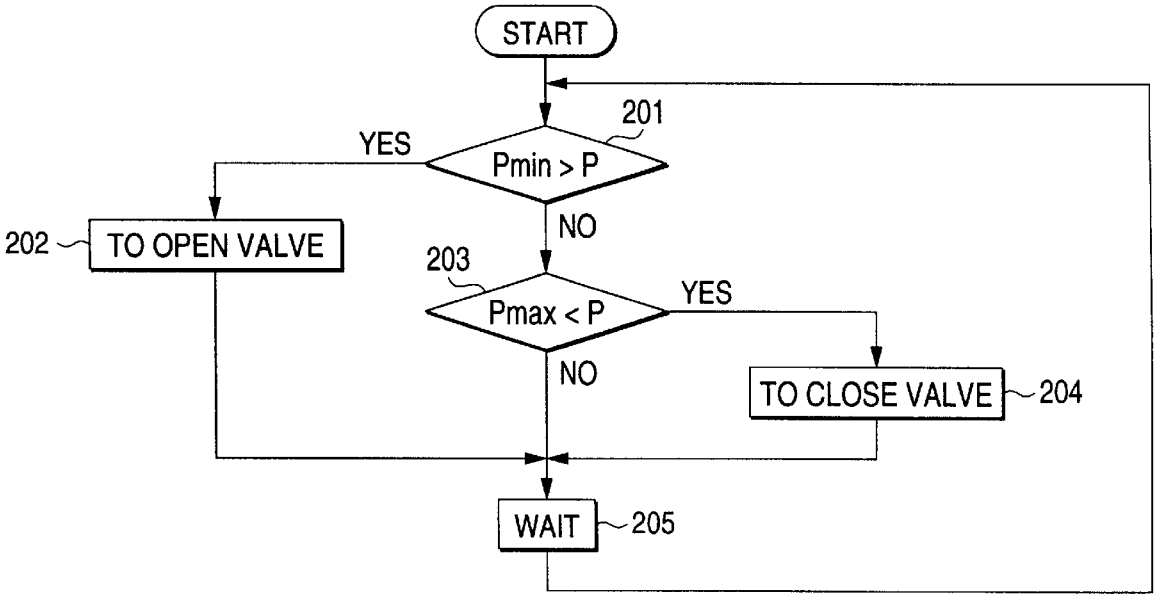
FIG. 4 is a flowchart illustrating a sequence of operations executed by the controller shown in FIG. 5.

The controller 21 performs processing as illustrated in FIG. 4.

First, a decision is made as to whether the actual vapor pressure P detected by the pressure sensor 25 is lower than a given pressure Pmin (e.g., atmospheric pressure corresponding to 0 kg/cm$^2$ on a pressure gauge) (step 201).

If the result of the decision made in step 201 is YES (i.e., the actual vapor pressure P is lower than the atmospheric pressure Pmin (corresponding to 0 kg/cm$^2$ on the pressure gauge), an opening command current is delivered to the motor 24 to increase the amount of opening of the proportional valve 23 by a given amount, thus driving it. The proportional valve 23 is opened by a given amount. This increases the area of the opening of the hot gas bypass line 18 (step 202).

On the other hand, if the result of the decision made in step 201 is NO (i.e., the actual vapor pressure P is equal to or higher than the atmospheric pressure Pmin (corresponding to 0 kg/cm$^2$ on the pressure gauge), then control goes to step 203, where a decision is made as to whether the actual vapor pressure P detected is higher than a pressure Pmax (corresponding to 0.5 kg/cm$^2$ on the pressure gauge) that is sufficiently higher than the pressure Pmin.

If the result of the decision made in step 203 is NO (i.e., the actual vapor pressure P read by the gauge is equal to or lower than the pressure Pmax (0.5 kg/cm$^2$) that is sufficiently higher than the atmospheric pressure, then the command current to the motor 24 is made to cease for a given time. Thus, the motor is in a standby state. That is, the degree of opening of the proportional valve 23 is maintained as it is. The degree of opening of the hot gas bypass line 18 is maintained for the given time (step 205).

Then, control goes back to step 201.

If the result of the decision made in step 203 is YES (i.e., the actual vapor pressure P is higher than Pmax (corresponding to 0.5 kg/cm$^2$ on the pressure gauge) that is sufficiently higher than the atmospheric pressure, a closing command current is delivered to the motor 24 to reduce the amount of opening of the proportional valve 23 by a given amount. As a result, the motor 24 is driven, closing the proportional valve 23 by the given amount. This reduces the area of the opening of the hot gas bypass line 18 (step 204).

As described thus far, in the present embodiment, if the vapor pressure P detected by the pressure sensor 25 becomes equal to or lower than the given pressure (atmospheric pressure), the proportional valve 23 is opened. Therefore, the vapor pressure P is maintained higher than the given pressure (atmospheric pressure). Consequently, liquid the phenomenon of the fluid back (i.e., the vapor pressure becomes equal to or lower than the atmospheric pressure, the refrigerant 16 does not sufficiently vaporize in the evaporator 11, and returns to the compressor 12 while maintained in a liquid state) can be prevented in the same way as the prior art pressure regulating valve 19. That is, damage to the compressor 12 and other dangers can be prevented.

Furthermore, in accordance with the present embodiment, the proportional valve 23 is actuated precisely according to the vapor pressure P detected by the pressure sensor 25. Therefore, if the vapor pressure P becomes higher than the given pressure (atmospheric pressure), the proportional valve 23 is prevented from being undesirably opened. Hence, the hot gas is prevented from being undesirably bypassed. In consequence, the refrigerating capability is prevented from deteriorating.

In this embodiment, the threshold value Pmin at which the proportional valve 23 is started to be opened is set to the atmospheric pressure. The threshold value may also be set to other values.

In the control illustrated in FIG. 4, the proportional valve 23 is opened or closed in equal increments. The proportional valve 23 may be so controlled as to achieve a target opening. In this case, in step 202 of FIG. 4, the proportional valve 23 is opened to a first target opening, or a large opening. In step 204, the valve 23 is closed to a second target opening, or a small opening.

Figure 6:
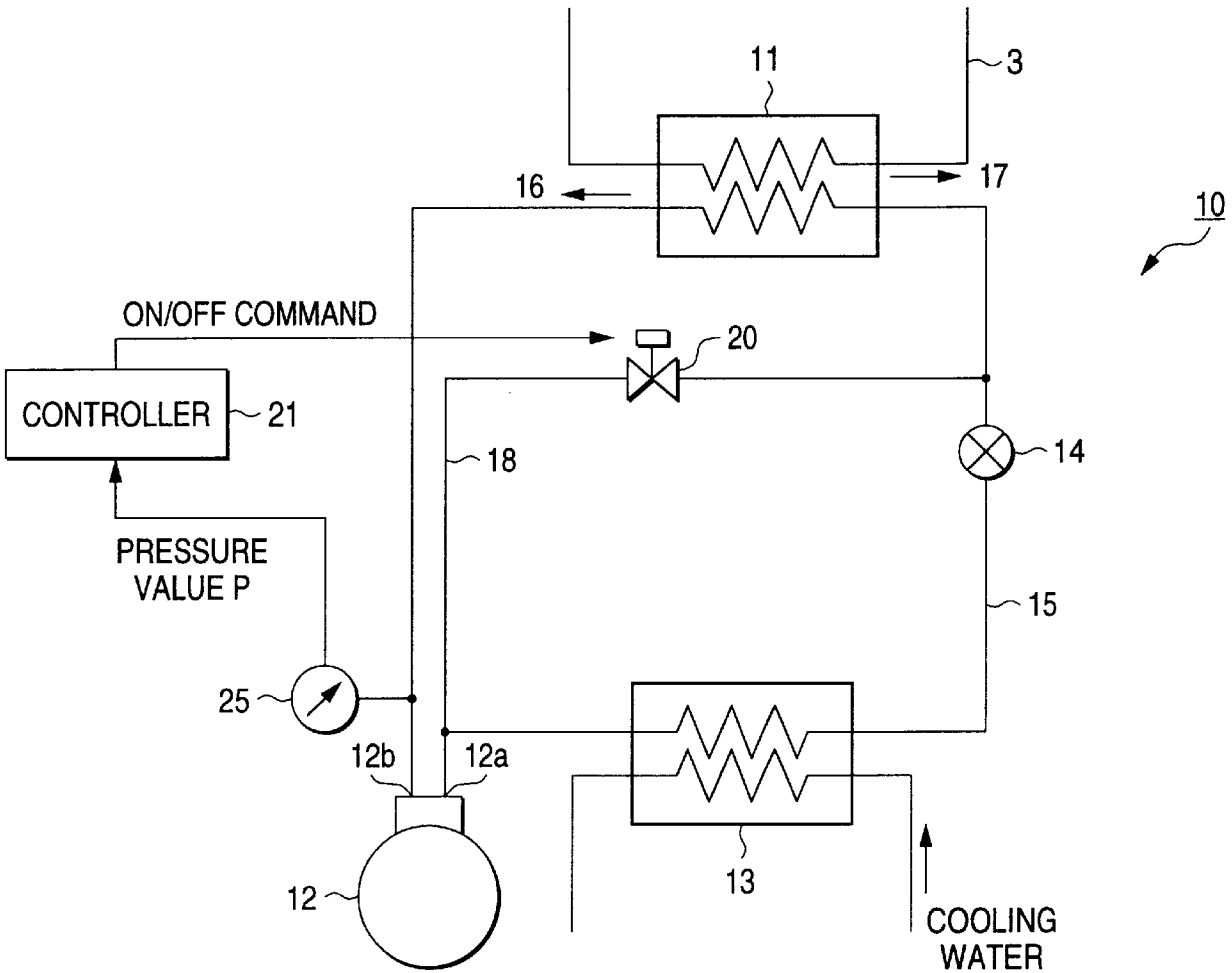
FIG. 6 is a line diagram of a modification of the refrigerating machine and control unit shown in FIG. 5.

A modification of the machine shown in FIG. 5 is next described by referring to FIG. 6.

In the machine shown in FIG. 6, a solenoid valve 20 is used instead of the proportional valve 23.

Figure 7:
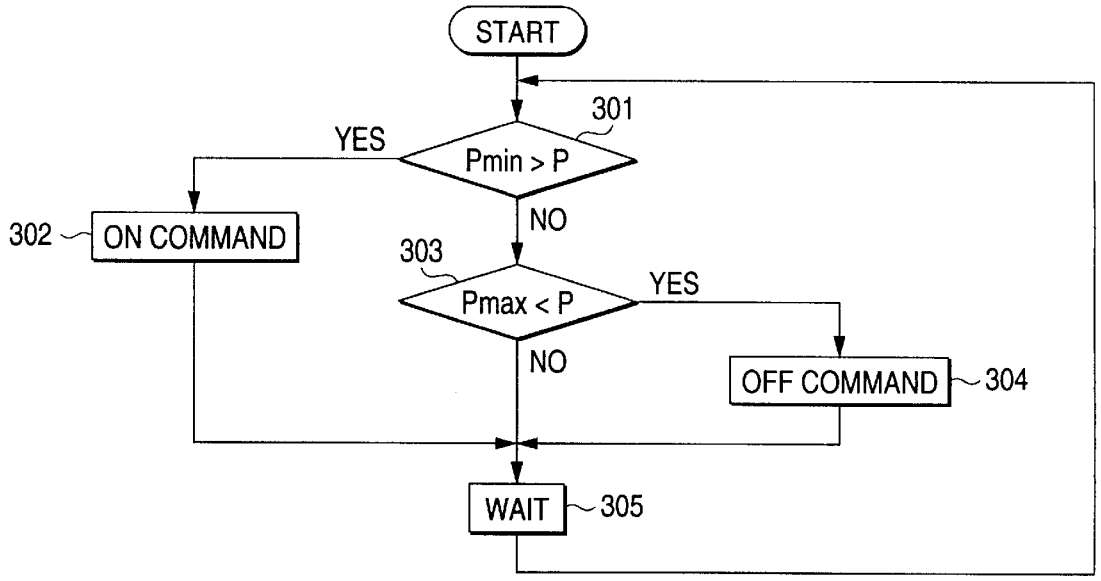
FIG. 7 is a flowchart illustrating a sequence of operations executed by a controller shown in FIG. 6.

A controller 21 performs processing as illustrated in FIG. 7.

First, a decision is made as to whether the actual vapor pressure P detected by the pressure sensor 25 is lower than a given pressure Pmin that is the atmospheric pressure corresponding to 0 kg/cm$^2$ on a pressure gauge (step 301).

If the result of the decision made in step 301 is YES (i.e., the actual vapor pressure P is lower than the atmospheric pressure Pmin (corresponding to 0 kg/cm$^2$ on the pressure gauge), control proceeds to step 302, where an ON command current is sent to the solenoid valve 20 to turn on the valve. As a result, the solenoid valve 20 is activated, opening the hot gas bypass line 18 (step 302).

If the result of the decision made in step 301 is NO (i.e., the actual vapor pressure P is equal to or higher than the atmospheric pressure Pmin (corresponding to 0 kg/cm$^2$ on the pressure gauge), control goes to step 303, where a decision is made as to whether the detected actual vapor pressure P is higher than a pressure Pmax (corresponding to 0.5 kg/cm$^2$ on the pressure gauge), the pressure Pmax being sufficiently higher than the pressure Pmin (step 303).

If the result of the decision made in step 303 is NO (i.e., the actual vapor pressure P is equal to or lower than the pressure Pmax (corresponding to 0.5 kg/cm$^2$ on the pressure gauge), the pressure Pmax being sufficiently higher than the pressure Pmin, then the command current to the solenoid valve 20 is made to cease for a given time. The valve waits until the next command current is supplied. That is, the state of the solenoid valve 20, whether it is open or closed, is maintained. The state of the hot gas bypass line 18, whether it is open or closed, is maintained for the given time (step 305).

Then control goes back to step 301.

If the result of the decision made in step 303 is YES (i.e., the actual vapor pressure P is higher than the pressure Pmax (corresponding to 0.5 kg/cm$^2$ on the pressure gauge), the pressure Pmax being sufficiently higher than the atmospheric pressure, an OFF command current is delivered to the solenoid valve 20 to deactivate it. As a result, the solenoid valve 20 is deactivated, thus closing the hot gas bypass line 18 (step 304).

Also in the embodiment illustrated in FIG. 6, the solenoid valve 20 is operated precisely according to the vapor pressure P detected by the pressure sensor 25, in the same manner as the embodiment illustrated in FIG. 5. Therefore, the vapor pressure can be maintained higher than the atmospheric pressure in the same way as the prior art pressure regulating valve 19. Liquid the phenomenon of the fluid back and other inconveniences can be prevented. Furthermore, the hot gas is prevented from being undesirably bypassed; otherwise, the refrigerating capability would be deteriorated.

In this embodiment, the threshold value Pmin at which the solenoid valve 20 is started to be opened is set to the atmospheric pressure. Other threshold values may also be employed.

In the embodiments illustrated in FIGS. 5 and 6, the vapor pressure P is directly detected by the pressure sensor 25. Instead, a temperature sensor may be installed in the line 15 between the evaporator 11 and the suction port 12*b* of the compressor 12 and between the thermostatic expansion valve and the evaporator to indirectly detect the vapor pressure P, because the vapor pressure P is uniquely determined by the temperature of the refrigerant 16 prior to passing through the evaporator 11.

In this case, the temperature detected by the temperature sensor is applied to the controller 21 as shown in FIGS. 5 and 6. As illustrated in FIGS. 4 and 7, a temperature Tmin corresponding to the pressure Pmin is used instead of the pressure Pmin. Instead of the pressure Pmax, a temperature Tmax corresponding to the pressure Pmax is used. Similar processing is carried out.

In the embodiments described thus far, the discharge port 12*a* of the compressor 12 is placed in the hot gas bypass line 18 to connect the discharge port with the line between the thermostatic expansion valve 14 and the entrance of the evaporator 11. The hot gas bypass line may also be arranged as shown in FIGS. 9(*a*)–9(*c*).

Figure 9:
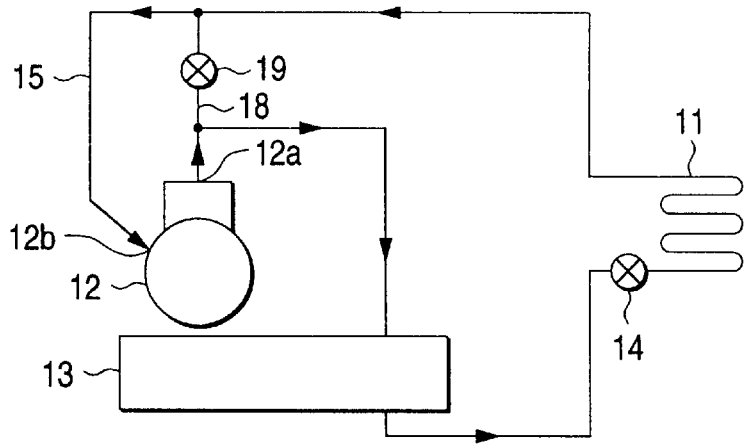
FIGS. 9(*a*), 9(*b*), and 9(*c*) are line diagrams of modifications of the structure of hot gas bypass lines.
Figure 9:
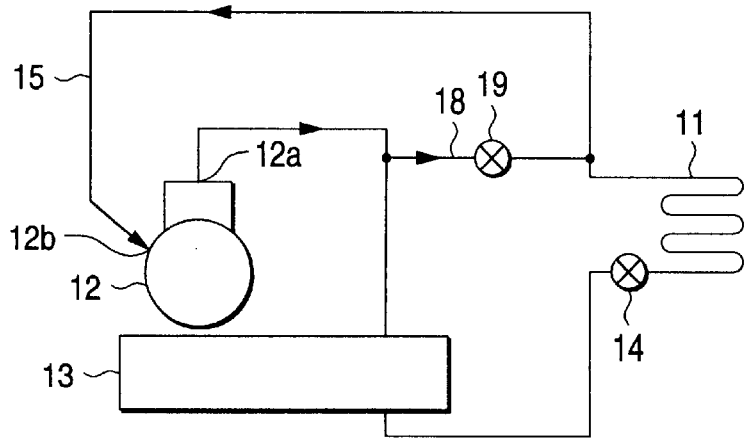
Figure 9:
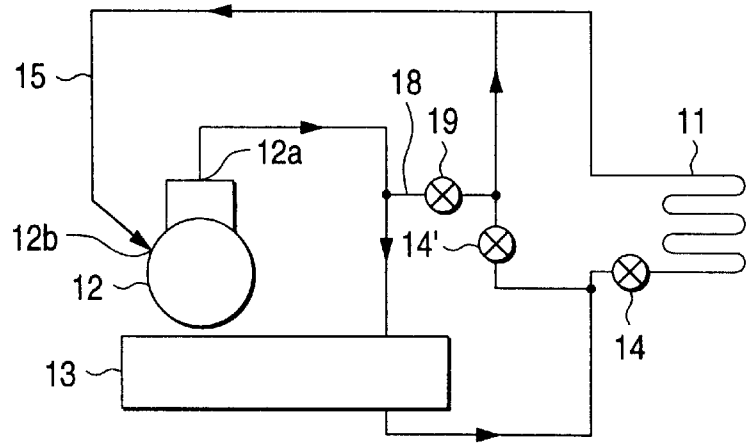

In FIG. 9(*a*), the discharge port 12*a* of the compressor 12 is placed in the hot gas bypass line 18 that places the discharge port 12*a* in communication with the line between the evaporator 11 and the suction port 12*b* of the compressor 12.

In FIG. 9(*b*), the discharge port 12*a* of the compressor 12 is connected with the hot gas bypass line 18 that places the discharge port 12*a* in communication with the vicinity of the outlet of the evaporator 11.

In FIG. 9(*c*), the discharge port 12*a* of the compressor 12 is connected with the hot gas bypass line 18 that places the discharge port 12*a* in communication with the line between the evaporator 11 and the suction port 12*b* of the compressor 12. An expansion valve 14' for cooling the hot gas is added.

The refrigerating machine in accordance with the present embodiment is intended to cool the brine 17 passing through the evaporator 11. The invention can also be applied to a heat pump having the condenser 11 to give heat to the outside air. That is, the refrigerating machine in accordance with the present invention embraces heat pumps as well as refrigerating machines.

What is claimed is:

1. A control unit for use with a refrigerating machine having a compressor, a condenser, and an evaporator that are connected in series via a conduit, said refrigerating machine having a refrigerant for exchanging heat with a brine passing through the evaporator to maintain said brine at a preset temperature, said control unit comprising:

a hot gas bypass line providing a bypass line for hot gas discharged from said compressor such that said hot gas is supplied to a line between said condenser and said evaporator;

a pressure regulating valve mounted in said hot gas bypass line to open said hot gas bypass line, if vapor pressure of the refrigerant inside said evaporator becomes equal to or lower than a given pressure, thereby passing the hot gas, and to close said hot gas bypass line, if the vapor pressure of the refrigerant inside said evaporator becomes higher than said given pressure, thereby cutting off said hot gas; and a temperature-responsive valve mounted in said hot gas bypass line to open said hot gas bypass line, if the preset temperature of said brine becomes equal to or higher than a given temperature, and to close said hot gas bypass line, if the preset temperature of said brine becomes lower than the given temperature.

2. The control unit of claim 1, wherein said temperature-responsive valve is a control valve opened and closed according to an ON/OFF command.

3. A control unit for use with a refrigerating machine having a compressor, a condenser, and an evaporator that are connected in series via a conduit, said refrigerating machine having a refrigerant for exchanging heat with a brine passing through the evaporator to maintain said brine at a preset temperature, said control unit comprising:

a hot gas bypass line providing a bypass line for hot gas discharged from said compressor such that said hot gas is supplied to a line between said condenser and said evaporator;

a pressure regulating valve mounted in said hot gas bypass line to open said hot gas bypass line, if vapor pressure of the refrigerant inside said evaporator becomes equal to or lower than a given pressure, thereby passing the hot gas, and to close said hot gas bypass line, if the vapor pressure of the refrigerant inside said evaporator becomes higher than said given pressure, thereby cutting off said hot gas; and a temperature-responsive valve mounted in said hot gas bypass line to open said hot gas bypass line, if actual temperature of said brine is set up equal to or higher than a given temperature, and to close said hot gas bypass line, if the actual temperature of said brine is set up lower than the given temperature.

4. The control unit of claim 3, wherein said temperature-responsive valve is a control valve opened and closed according to an ON/OFF command.

* * * * *